US005685097A

United States Patent [19]

Marinov

[11] Patent Number: 5,685,097

[45] Date of Patent: Nov. 11, 1997

[54] ILLUMINATED COLORED DISPLAY DEVICE

[75] Inventor: Daniel Marinov, Quarry Bay, Hong Kong

[73] Assignee: Haggerty Enterprises, Inc., Chicago, Ill.

[21] Appl. No.: 575,255

[22] Filed: Dec. 20, 1995

[51] Int. Cl.[6] ..... G09F 13/32

[52] U.S. Cl. ..... 40/431; 362/283; 362/811

[58] Field of Search ..... 40/431, 436, 444; 362/811, 283, 284, 336

[56] References Cited

U.S. PATENT DOCUMENTS

| | | | |
|---|---|---|---|
| D. 99,235 | 4/1936 | Wolfson . | |
| D. 102,868 | 1/1937 | Barrett . | |
| 1,099,879 | 6/1914 | Hutchings | 40/431 |
| 1,178,732 | 4/1916 | Koken | 40/431 |
| 1,612,362 | 12/1926 | Decker | 40/431 |
| 1,652,779 | 12/1927 | Gillinder | 362/356 |
| 1,871,073 | 8/1932 | Walker | 40/431 |
| 2,608,779 | 9/1952 | Joy | 40/431 |
| 2,702,850 | 2/1955 | Harling | 362/336 |
| 2,867,716 | 1/1959 | Ream | 362/811 X |
| 3,179,791 | 4/1965 | Mole | 362/806 X |
| 3,686,494 | 8/1972 | Naylor | 362/811 X |
| 3,791,058 | 2/1974 | Mollica | 362/811 X |
| 3,964,194 | 6/1976 | Gugeler | 362/811 X |
| 5,065,289 | 11/1991 | Teng | 362/269 X |
| 5,339,224 | 8/1994 | Woehler | 362/35 |
| 5,394,309 | 2/1995 | Brown | 362/806 X |
| 5,442,524 | 8/1995 | Farmer | 362/284 X |

*Primary Examiner*—Joanne Silbermann
*Attorney, Agent, or Firm*—Keck, Mahin & Cate

[57] ABSTRACT

An illuminated colored display device having a pair of counter rotating translucent members bearing colored patterns thereon, and a light distorting, magnifying and reducing, member surrounding a source of light, such that when viewed from a fixed location the display device a changing display of colors and shapes is observed.

13 Claims, 3 Drawing Sheets

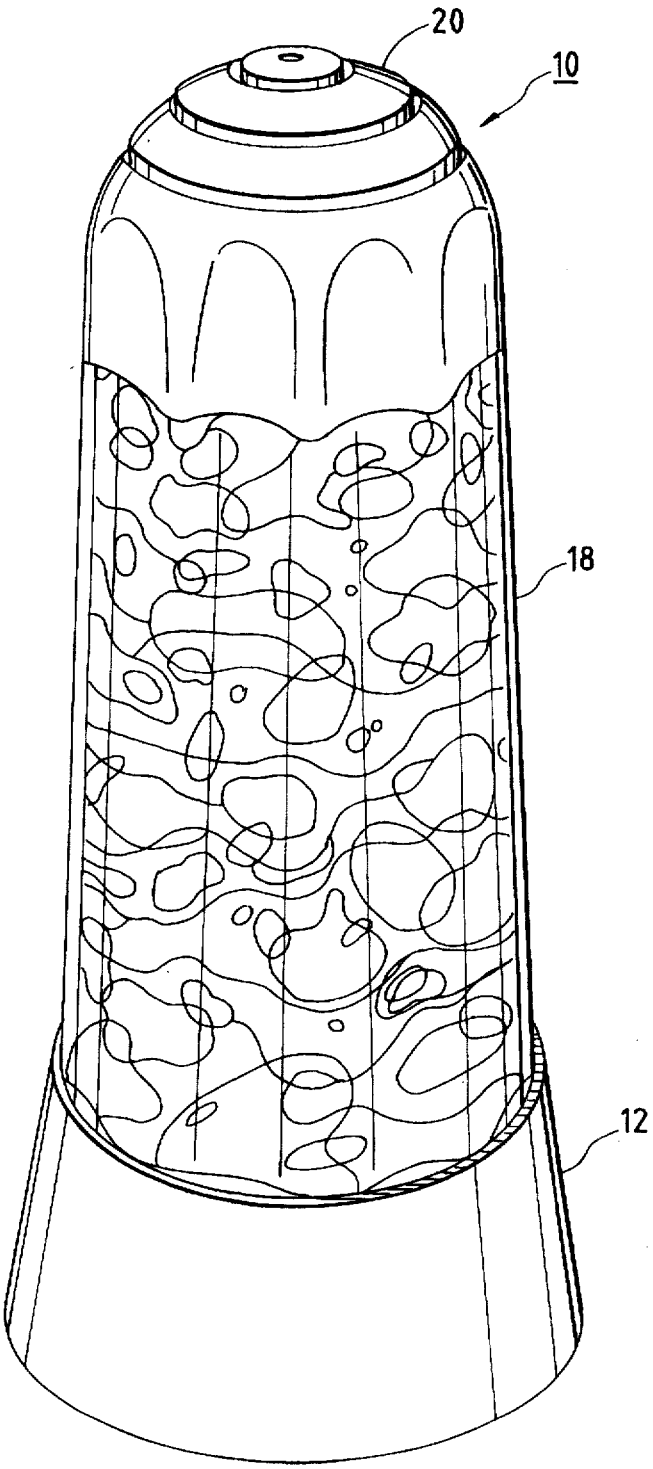
FIG. 2
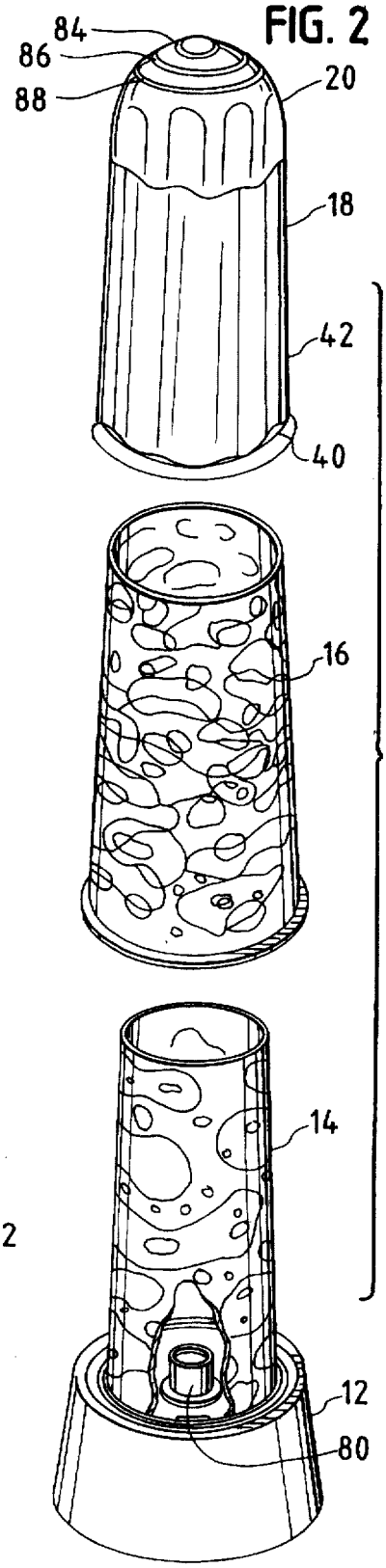

ILLUMINATED COLORED DISPLAY DEVICE

BACKGROUND OF THE INVENTION

1. Field of the Invention

This invention relates to illuminated colored display devices, and more particularly to a display device which presents the visual effect of changing colors in changing patterns of shapes when viewed by an observer.

2. Description of Related Art Including Information Disclosed under Secs. 1.97–1.99

Various types of ornamental illuminated display devices have been provided in the past. Some of these devices have obtained a desired visual effect of changing light patterns by passing light through liquids contained within transparent housings located between the viewer and the source of light. Two or more liquids of different colors may be utilized, with air bubbles being passed through the liquids to provide changing colors and patterns. Typical of such devices are those shown in U.S. Pat. Nos. 3,613, 264 - Vitka et al, 3,706,149 - Olivieri, and 3,964,194 - Gugeler. For instance, the Gugeler patent describes a changeable color device wherein an illumination source is located within three concentric cylinders formed of a light transmissive material, between pairs of which air is bubbled through a liquid.

Other ornamental illuminated display devices have obtained the desired visual effect of changing light patterns by causing the movement of one or more light transmissive means of varying shapes and colors with respect to the light source. Typical of such devices are those shown in the following Unites States patents:

| | |
|---|---|
| 2,867,716 — Ream | 3,791,058 — Mollica |
| 3,179,791 — Mole | 5,065,289 — Teng |
| 3,686,494 — Naylor | 5,394,309 — Brown |

The Ream patent discloses an ornamental display device wherein a bulb is located in a rotating drum which is provided with perforations through which light projects to a clear plastic cylindrical shell. The Mole patent describes an illuminating device wherein three lens of different colors are mounted in a triangular form on a support which rotates about a light source. The light passing through the lens also passed through an aperture formed in the spherical housing containing the light source and lens.

The Naylor patent illustrates a lighting apparatus wherein two concentric cylindrical light transmissive members having designs thereon are caused to counter-rotated around a light source. The heat generated by the light source causes air currents to engage blades secured to the cylinders to cause them to rotate. The Mollica patent sets forth a device for providing visual effects including a source of black light located within a rotatable hollow cylindrical translucent element having a pattern thereon subject to fluorescence. The translucent element is surrounded by a cylindrical lens which is located within a translucent rectangular housing.

The Teng patent reveals a display device which includes a crystal ball having a plurality of concave and convex portions which when filled with water form concave and convex lens through which is observed a decorative article within the ball. The ball is caused to rotate with respect to the base on which it is supported. The Brown patent is directed to a submersible device for changing colors in an aquarium, wherein a domed member having transparent plates of varying colors is caused to rotate around a light source, with the light of varying colors projecting into the water through clear transparent windows in a housing enclosing the device.

SUMMARY OF THE INVENTION

It is an object of this invention to provide an illuminated colored display device which presents the visual effect of changing colors in changing patterns of shapes when viewed by an observer. It is a further object of this invention to provide an illuminated colored display device which is readily adapted to provide changing colors in different hues and in different changing patterns. It is a still further object of this invention to provide such an illuminated colored display device which is readily assembled from limited number of components which are readily manufactured.

In accordance with this invention an illuminated colored display device is provided which includes a base, and at least two translucent members which are supported on turntables which are in turn supported by the base and are rotated with respect to the base by a drive system included in the base. The translucent members, which in the preferred embodiment are of a frustum shape, surround a source of illumination which is also supported on the base. Colored patterns consisting or areas of two or more colors or clear areas are provided on the translucent members. A third translucent member, which is supported on the base in a fixed position is of the same general shape as the others, but is formed with regions of varying thickness such that it distorts the light passing through it so as to both magnify and reduce the various colored areas to provide a visual effect which varies in color, and shape. An opaque cover is supported on the third translucent member over the ends of all of the translucent members. The translucent members may be lifted from the base to gain access to the source of illumination which in the preferred embodiment is an electric light bulb.

Other objects and further details of this invention will be set forth my making reference to the following drawings and specification.

BRIEF DESCRIPTION OF THE DRAWINGS

FIG. 1 is a perspective view of an illuminated decorative device in accordance with this invention.

FIG. 2 is an exploded perspective view of the illuminated decorative device in accordance with this invention.

DETAILED DESCRIPTION OF THE PREFERRED EMBODIMENT

Figure 3:
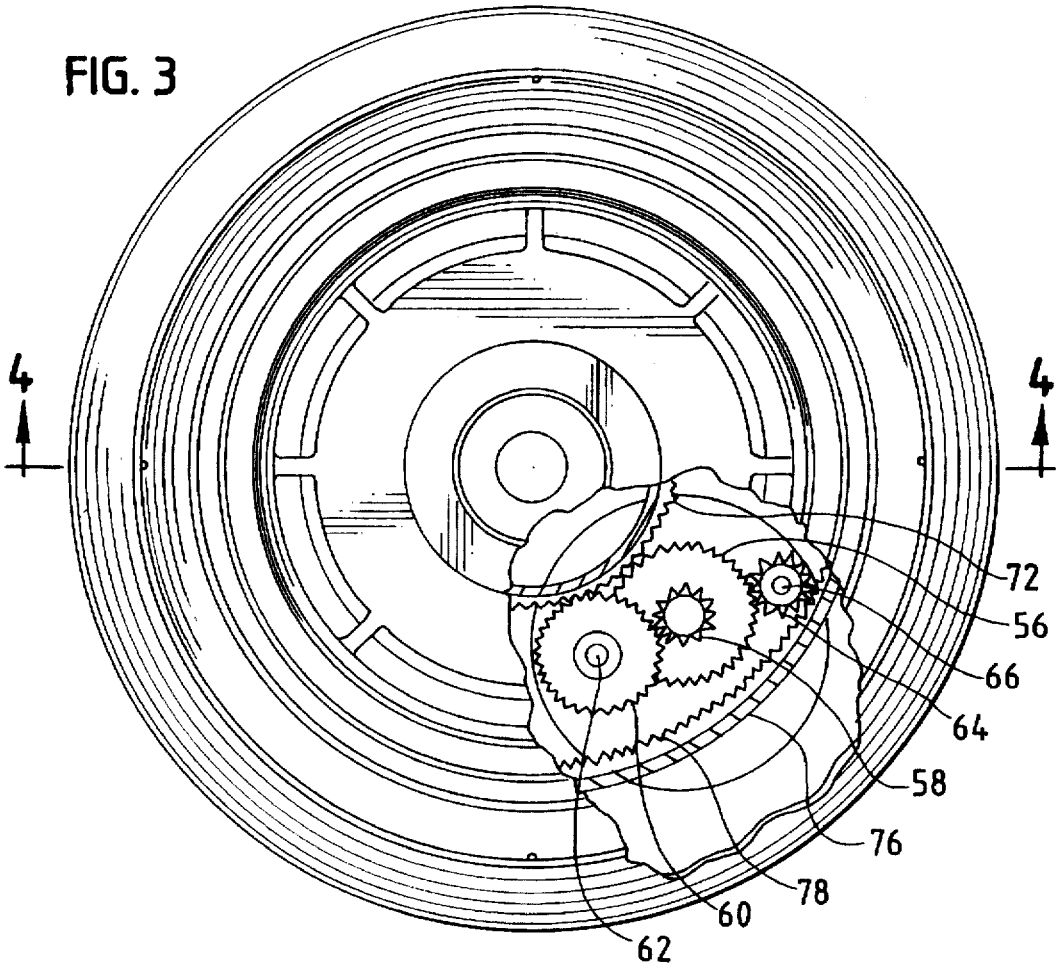
FIG. 3 is a top plan view with portions removed and other portions broken away of the base of the illuminated decorative device in accordance with this invention.

Referring to FIGS. 1 and 2, a preferred embodiment of the illuminated decorative device 10 of this invention is shown. The principal components of the illuminated decorative device are a base 12, a first translucent member 14, a second translucent member 16, a third translucent member 18 and a cap 20.

The first, second and third translucent members 14, 16 and 18 are of a generally cylindrical or more particularly a frustum shape, with the larger diameter end being positioned toward the base and the smaller diameter end being positioned away from the base. The second translucent member 16 is of a larger diameter than the first translucent member 14, and the third translucent member 18 is of a larger diameter than the second translucent member 16, such that the third translucent member may be placed around the second and the second around the first. In the preferred embodiment of this invention, the first, second and third translucent members are formed of a clear translucent plastic body.

Figure 5:
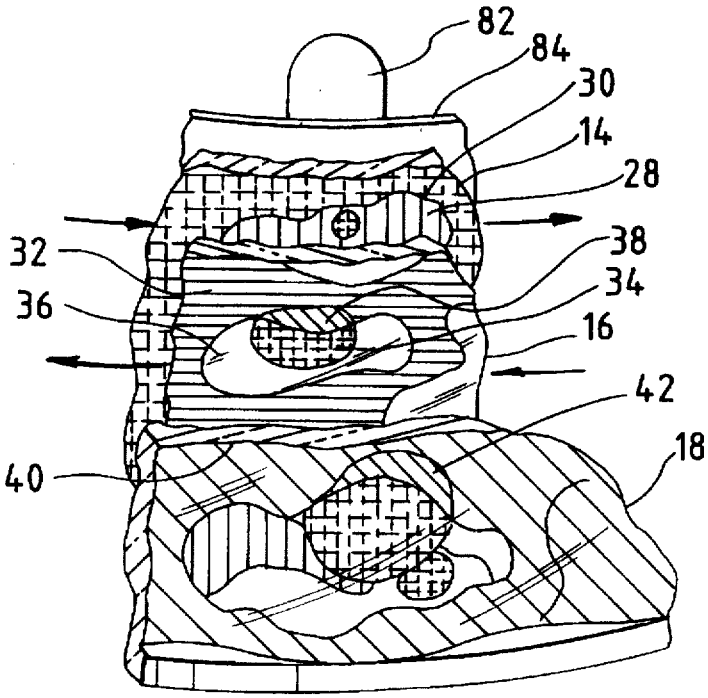
FIG. 5 is an exploded fragmentary view of a portion of the illuminated decorative device in accordance with this invention.
Figure 6:
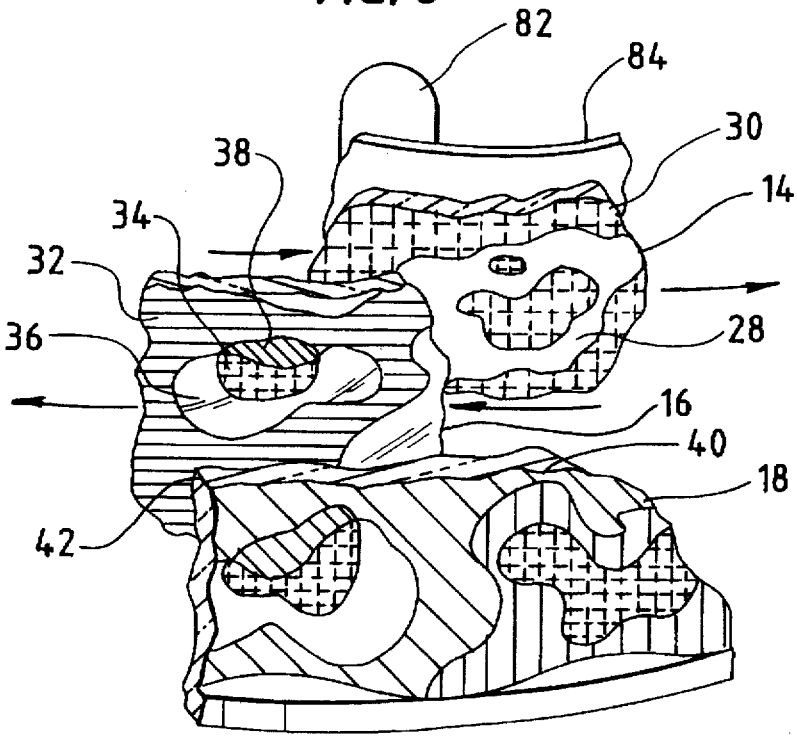
FIG. 6 is an exploded fragmentary view similar to FIG. 5 showing portions of the illuminated decorative device in accordance with this invention in a different position.

Translucent color patterns are provided on the surfaces of the first and second translucent members 14 and 16. As shown in FIGS. 2, 5, and 6, a two-color pattern consisting of red 28 and yellow 30 areas is provided on the surface of the first translucent member 14. This color pattern may be applied in various ways, such as by painting, for instance by silk screen or by securing a transparent film formed with areas of each of the colors, to the member 14, or by applying two films, each of which bears one of the colors. Similarly, a colored pattern is provided on the surface of the second translucent member 16. As illustrated in FIGS. 2, 5, and 6, blue 32 and yellow 34 areas are provided, as well as clear areas 36. Further, in some areas, the blue and yellow overlap so as to provide a generally green area 38. Again, the colored areas may be provided in numerous different ways known in the art.

The third translucent member 18 has a generally smooth inner surface and a wave-like outer surface, such that it has alternate thin areas 40 and thick areas 42. These alternating thin and thick areas provide a vertically oriented pattern of alternating magnifying and reducing portions.

Figure 4:
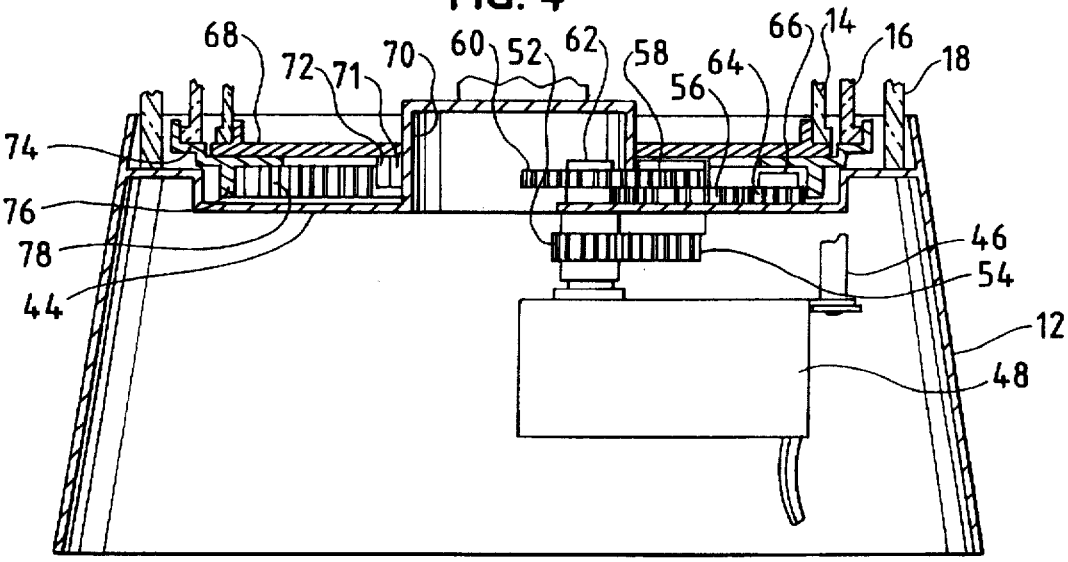
FIG. 4 is a cross-sectional view of the base of the illuminated decorative device in accordance with this invention taken along the lines 4—4 in FIG. 1.

As will be more fully explained hereafter with reference to FIGS. 3 and 4, a drive system is provided in the base 12, which in conjunction with turntables supporting the first and second translucent members 14 and 16, causes each of them to rotate with respect to the base in an opposite direction with respect to each other. Thus, with the first and second translucent members rotating in the illuminated decorative device as shown in FIG. 1, varying patterns of shape and color are observed at a fixed point spaced from the illuminated decorative device.

Referring now to FIGS. 3 and 4, the drive system which causes the first and second translucent members to rotate with respect to the base and in opposite directions with respect to each other will be described. The truncated cone-shaped base 10 is provided with a top 44, from which is suspended by downwardly projecting posts 46, a portion of one of which is shown, an electric drive motor 48. The output shaft of the drive motor has affixed thereto a gear 52 which engages a gear 54 which is connected to a shaft, (not shown) which extends through the top 44 and has secured thereto a pair of gears 56 and 58 which are of different diameters. The smaller diameter gear 58 drives still another gear 60 which is supported on a post 62 extending from the base 44. The gear 56 also drives a gear 64 which is supported from another post 66 which extends from the base 44.

A first turntable 68 as shown in FIGS. 3 and 4 is provided for supporting the first translucent member 14. The first turntable 68 has an aperture therein such that it fits over an upwardly extending cylindrical member 70 of the top 44. A downwardly projecting cylindrical member 71 is provided on the first turntable 68. Formed on the outer surface of the cylindrical member 71, which surrounding the cylindrical member 70, is a gear 72 which engages the teeth of gear 60, as is best seen in FIG. 3, so as to be driven by the motor 48.

Similarly, a second turntable 74 is provided for supporting the second translucent member 16. The second turntable 74 is provided with a downwardly extending cylindrical portion 76, on the inner surface of which is formed a gear 78. As best seen in FIG. 3, the gear 78 is engaged by the gear 64 such that the second turntable 74 is also driven by the electric motor 48.

To summarize, the drive train for the first turntable 68, which supports the first translucent member 14 includes gears 52, 54, 56, 60 and 72. The drive train for the second turntable 74, which supports the second translucent member 16, includes gears, 52, 54, 58, 64 and 78. It will be apparent to a person skilled in the art that by varying the diameters of the various gears involved in the gear trains, the speeds of rotation of the turntables 68 and 74 may be changed with respect to the base 12, and also with respect to each other. Thus, with the drive trains as shown, energization of the motor 48 will cause the turntables 68 and 74 and therefore the first and second translucent members 14 and 16 to rotate in opposite directions with respect to each other.

Supported in the center of base 12 is a electrical lamp socket 80 for receiving and energizing a source of illumination 82 such as an incandescent light bulb as shown in FIGS. 5 and 6. The energized light bulb provides light which is transmitted through first, second and third translucent members to a viewers eyes.

Referring to FIGS. 5 and 6, the light source 82 is shown along with exploded, partial sectional views, of the first translucent member 14, the second translucent member 16 and the third translucent member 18. In accordance with conventional standards for designating color, the first translucent member is shown to have a pattern of red and yellow areas. Similarly, the second translucent member is shown to have blue, yellow, green and clear areas. As light from the light source 82 passes through the first and second translucent members 14 and 16 and the colors thereon, changing color patterns are observed through the third translucent member 18 due to the motion of the first and second translucent members 14 and 16 with respect to each other. It should be understood that the colors represented on the third translucent member 18, in FIGS. 5 and 6 are those which are viewed from an external point. The colcrs do not represent actual colored areas of the third translucent member, but rather the changing colors of the light which has passed through members 14 and 16. FIG. 6, is similar to FIG. 5, but shows the first and second translucent members 14 and 16 in a subsequent position with respect to each other. A comparison of the colored areas on third translucent member 18 in FIGS. 5 and 6 illustrates the changing of the pattern and of the color as observed through member 18 due to the displacement of members 14 and 16 with respect to each other.

As shown in FIGS. 5 and 6, a translucent but light dispersing thin member 84 may be provided between light source 82 and the first translucent member 14, to disperse the light emitted from the source 82, so as to eliminate the viewing of a particularly bright spot through the three translucent members.

Finally, in a preferred embodiment, an opaque cap 20 is placed upon the top of the third translucent member 18 and supported thereby. Annular openings 84, 86 and 88 are provided in the top of the cap 20 to permit The convective air flow through the base and inside the first translucent member 14 around the lamp 82 to dissipate the heat generated thereby.

It should be further noted that the first, second and third translucent members and the cap 20 may be easily lifted off the base 12 and the turntables 68 and 74 to gain access to the bulb 82.

While a particular embodiment of the invention has been shown, it would be apparent to one skilled in the art that the particular shape of the base 12 and of the first, second and third translucent members 14, 16, and 18 could be readily changed as could the pattern of colors and the colors provided on the first and second translucent members 14 and 16. Further, rather than providing the alternating thick and thin wall portions in third translucent member 18, so as to provide alternately reducing and magnifying areas, it could be of uniform thickness or of irregular thickness in various arrangements.

It should be apparent to those skilled in the art that while what has been described are considered at present to be the preferred embodiments of the illuminated colored display device of this invention, in accordance with the patent statutes, changes may be made in the illuminated colored display device without actually departing from the true spirit and scope of this invention.

The appended claims are intended to cover all such changes and modifications which fall within the true spirit and scope of this invention.

What is claimed is:

1. An illuminated decorative device comprising:

a base;

a source of illumination supported on said base;

a first translucent member supported on said base, said first translucent member having a pattern formed thereon of at least two colors, said first translucent member surrounding said source of illumination;

a second translucent member supported on said base, said second translucent member having a pattern formed thereon of at least two colors, said second translucent member surrounding said first translucent member;

a third translucent member supported on said base surrounds said second translucent member, said third translucent member is formed with magnifying and reduction portions; and a drive system supported on said base, said drive system moving said first translucent member with respect to said base, said drive system moving said second translucent member with respect to said base and with respect to said first translucent member, whereby the illumination from said source of illumination as observed through said third translucent member is a varying pattern of colors, shapes and magnification thereof depending upon the relative positions of said first, second and third translucent members with respect to each other.

2. The illuminated decorative device of claim 1, wherein said first and second translucent members are of a generally cylindrical shape, with said second translucent member being of a larger diameter than the first translucent member.

3. The illuminated decorative device of claim 1, wherein said first and second translucent members are of a frustum shape, with said second translucent member being of a larger diameter than the first translucent member.

4. The illuminated decorative device of claim 1, wherein said first translucent member has a pattern formed thereon of two different colors.

5. The illuminated decorative device of claim 1, wherein one of said first and second translucent members has a pattern formed thereon by two transparent colored portions and a clear portion, with portions of said two colors overlying each other.

6. The illuminated decorative device of claim 1, wherein said translucent members are formed of transparent colorless base, with said pattern of transparent colors being applied thereto.

7. The illuminated decorative device of claim 1, wherein a first end of said third translucent member is supported on said base, and a cover is secured to a second end of said third translucent member.

8. The illuminated decorative device of claim 1, wherein said first, second, and third translucent members are of a generally cylindrical shape, with said second translucent member being of a larger diameter than the first translucent member and the third translucent member being of a larger diameter than the second translucent member.

9. The illuminated decorative device of claim 1, wherein said first, second, and third translucent members are of a frustum shape, with said second translucent member being of a larger diameter than the first translucent member and the third translucent member being of a larger diameter than the second translucent member.

10. The illuminated decorative device of claim 1, wherein said drive system causes said first translucent member to move in a first direction and said second translucent member to move in a direction opposite said first direction.

11. The illuminated decorative device of claim 10, wherein said drive system includes first and second counter rotating turntables, said first turntable supporting said first translucent member and said second turntable supporting said second translucent member.

12. The illuminated decorative device of claim 1, wherein said source of illumination is electrically energized.

13. A decorative lamp comprising:

a base;

a drive system housed in said base;

an illumination source supported on said base;

a first translucent member having portions of different colors surrounds said illumination source and is supported on said base;

a second translucent member having portions of different colors surrounds said first translucent member and is supported on said base; and a third translucent member surrounding said second translucent member and is supported on said base. Said third translucent member has magnifying portions through which said illumination passes, said drive system causing said first and second translucent members to move with respect to each other, and with respect to said base and said third translucent member, whereby the color and pattern of the illumination emitted through said third translucent member is of a changing pattern, color and magnification thereof when observed from a fixed position spaced from the lamp.

* * * * *